United States Patent [19]

Toy et al.

[11] 4,187,759

[45] Feb. 12, 1980

[54] SEPARATION NUT SYSTEM

[75] Inventors: Henry Toy, Los Altos; Phillip Bernstein, Sunnyvale; Johan C. Van der Zwaan, Los Altos, all of Calif.

[73] Assignee: The United States of America as represented by the Secretary of the Navy, Washington, D.C.

[21] Appl. No.: 833,834

[22] Filed: Sep. 16, 1977

[51] Int. Cl.[2] ..... F42B 15/10

[52] U.S. Cl. ..... 89/1 B; 89/1.5 F; 85/DIG. 1; 102/49.5

[58] Field of Search ..... 89/1 B, 1 R, 1.5 F; 85/33, DIG. 1, 1 R; 29/254, 421 E; 102/49.5

[56] References Cited

U.S. PATENT DOCUMENTS

| | | | |
|---|---|---|---|
| 3,114,962 | 12/1963 | Brown | 83/DIG. 1 X |
| 3,204,515 | 9/1965 | Dickie | 85/DIG. 1 X |
| 3,262,351 | 7/1966 | Webb | 89/1 B X |
| 3,517,583 | 6/1970 | Fortenberry | 85/DIG. 1 X |
| 3,597,919 | 8/1971 | Lilly | 102/49.5 X |
| 3,784,132 | 1/1974 | Newell | 89/1.5 F X |
| 3,813,984 | 6/1974 | Selinder | 85/DIG. 1 X |
| 3,883,097 | 5/1975 | Billot | 89/1.5 F X |
| 3,910,154 | 10/1975 | Gardner | 89/1 B X |
| 4,002,120 | 1/1977 | Swales | 85/DIG. 1 X |
| 4,015,507 | 4/1977 | Toy et al. | 89/1.5 F |

*Primary Examiner*—David H. Brown

*Attorney, Agent, or Firm*—R. S. Sciascia; Charles D. B. Curry; Francis I. Gray

[57] ABSTRACT

A separation nut system having bolt ejecting separation nut assemblies combined with bolt catcher assemblies. At least two separation nut assemblies with their respective bolt catcher assemblies are connected by a manifold tube so that, should the squib initiator of one separation nut assembly fail, the manifold tube will transfer and redistribute the gas generated from one squib to both separation nut assemblies to provide performance redundancy. Also, each separation nut assembly is capable of being tested for performance integrity prior to actual usage without the need for disassembly and subsequent reassembly and inspection after each use.

6 Claims, 11 Drawing Figures

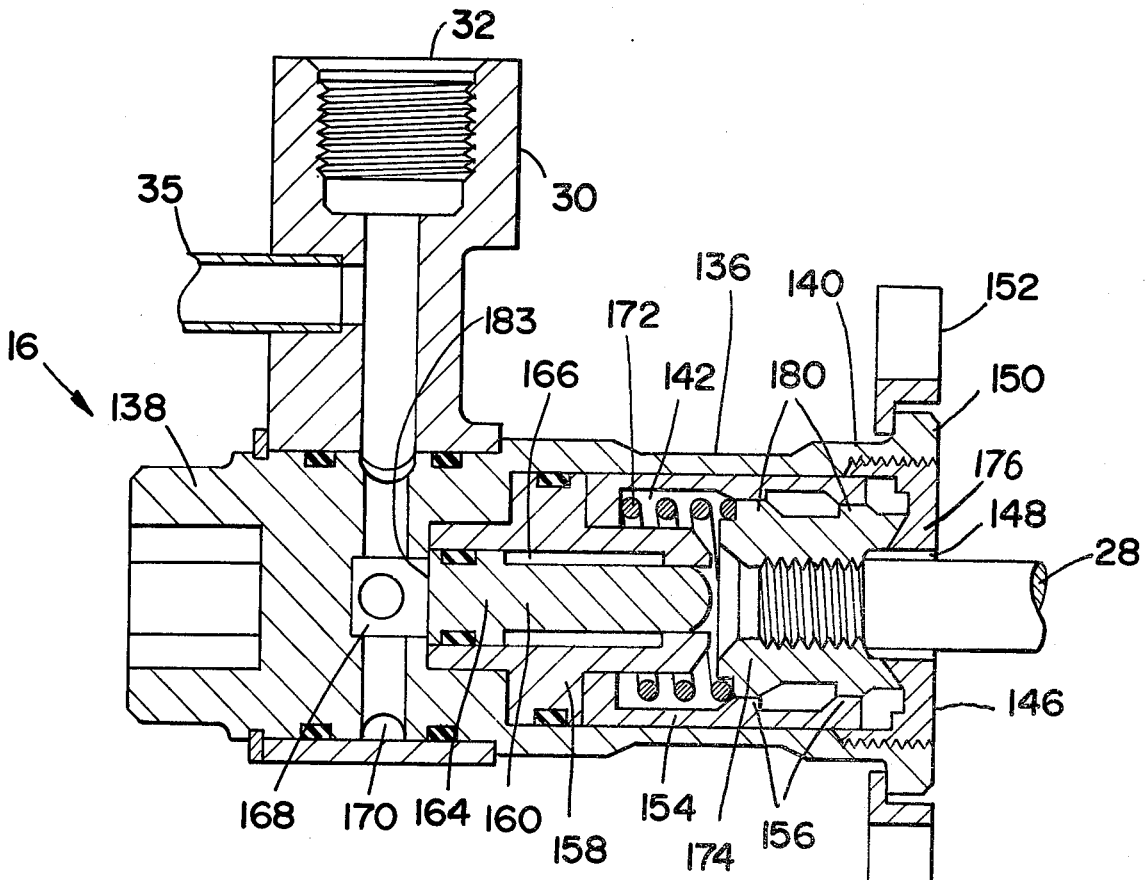
FIG_5
FIG_6a
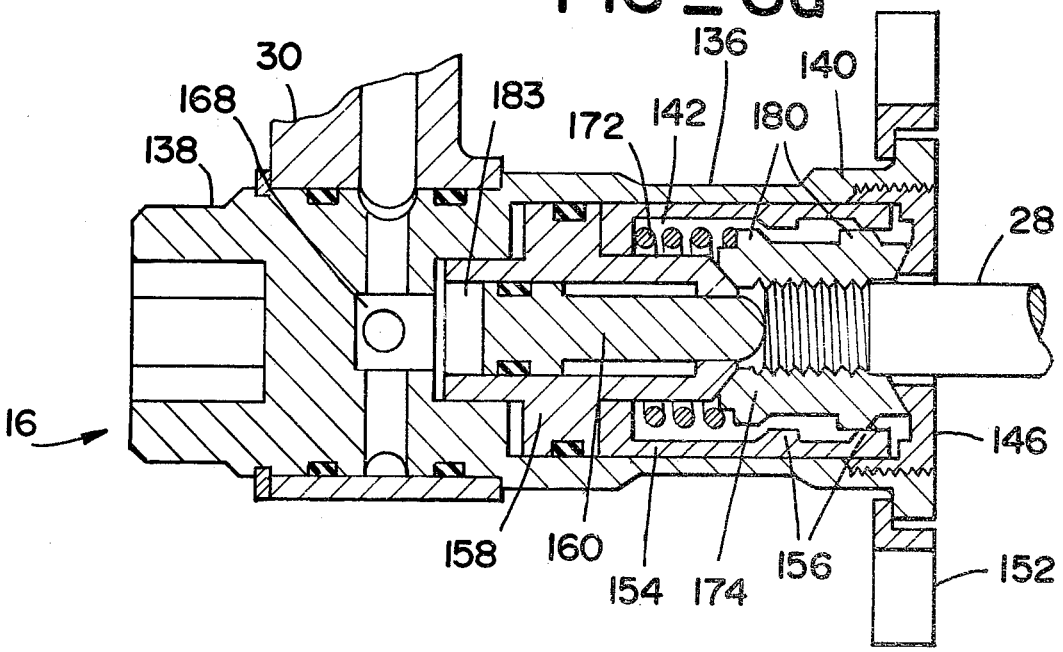

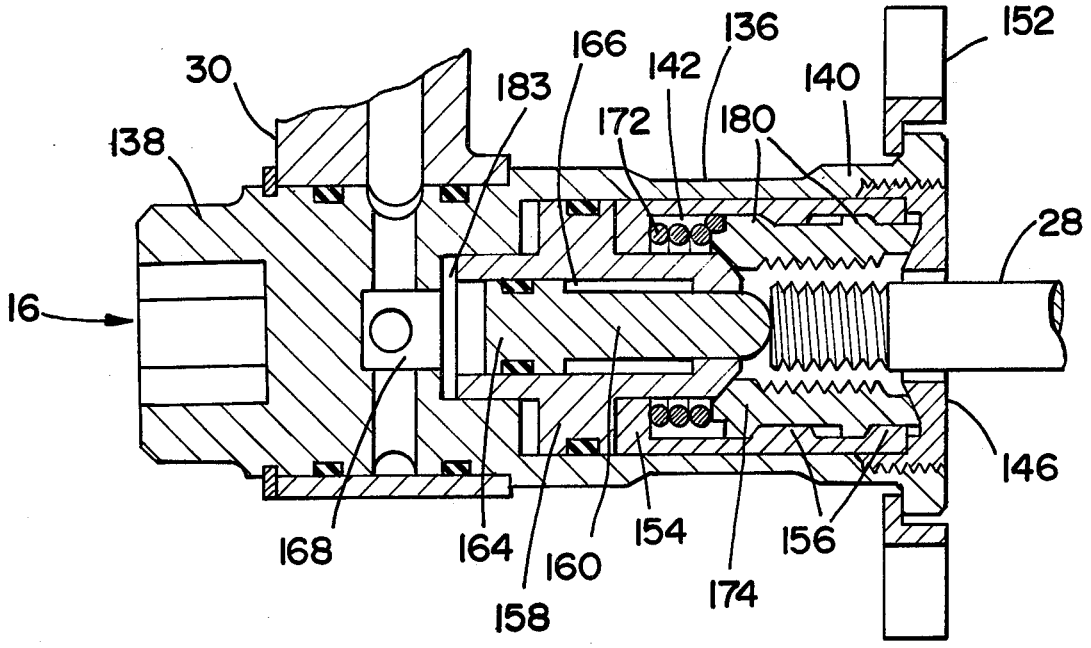
FIG_6b
FIG_6c
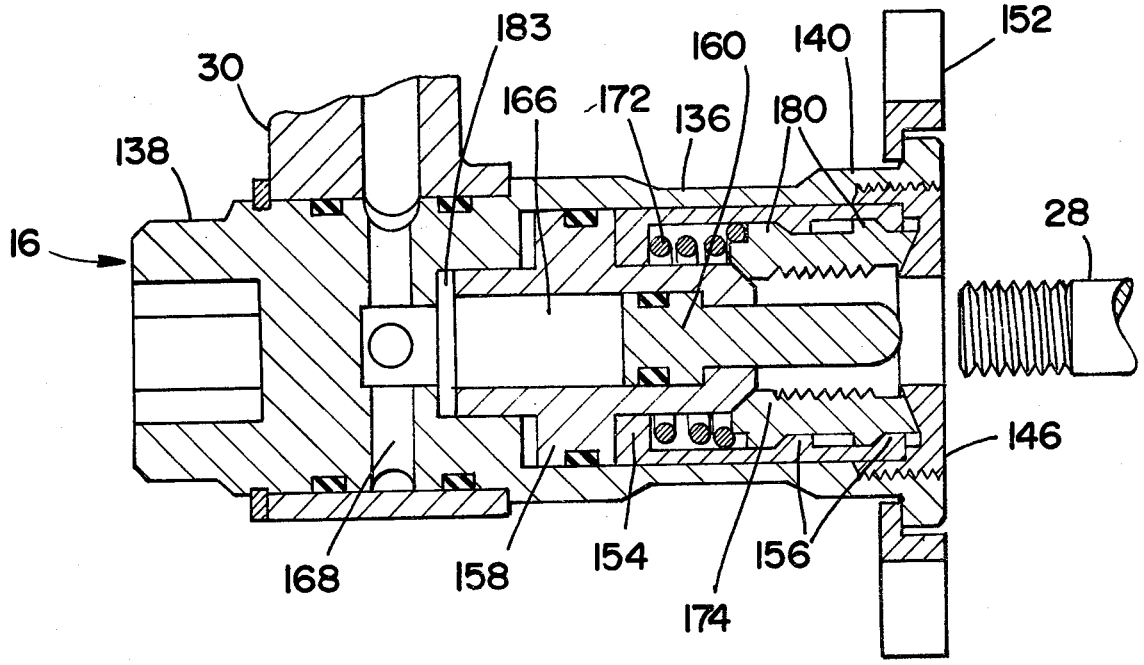

SEPARATION NUT SYSTEM

BACKGROUND OF THE INVENTION

1. Field of the Invention

The present invention relates to separation systems, and more particularly to separation systems having bolt ejecting separation nut assemblies combined with bolt catcher assemblies.

2. Description of the Prior Art

To provide separation of two planes, such as for staging in spacecraft and in missiles, various types of separation devices, including separation nuts, explosive bolts, pin pullers and separation joints to name a few, have been used. These devices are generally initiated by explosive devices called squibs which generate a large volume of gas to perform the work. In aerospace applications a certain amount of redundancy is desired since there is generally no way to repair a malfunction during flight. Although squibs are highly reliable, some separation devices have used two squibs per device to achieve the desired redundancy at the cost of the added weight and added electrical power required for initiation.

Additionally, testing of the separation devices prior to actual use is desired to demonstrate performance reliability. Presently this cannot be done without complete disassembly and reassembly after testing prior to actual use, resulting in added man-hours with the chance for error in reassembly which would invalidate the test.

SUMMARY OF THE INVENTION

Accordingly, the present invention provides a separation nut system which provides performance redundancy without a second squib, and which can be tested to demonstrate performance reliability without disassembly and reassembly of the system prior to actual use. At least two separation nut assemblies with their respective bolt catcher assemblies are connected by a manifold tube so that, should the squib initiator of one separation nut assembly fail, the manifold tube will transfer and redistribute the gas generated from one squib to both separation nut assemblies to provide performance redundancy. Also, each separation nut assembly is provided with a restoring device to return the separation nut assembly to its initial configuration after the bolt has been ejected so that the separation nut system can be tested using cold gas instead of a squib for actuation to demonstrate performance reliability without disassembly and reassembly prior to actual use.

Therefore, it is an object of the present invention to provide a separation nut system having performance redundancy.

A further object of the present invention is to provide a separation nut system capable of being tested to demonstrate performance reliability without complete disassembly and reassembly prior to actual use.

Yet another object of the present invention is to provide a separation nut system which is extremely lightweight.

Additional objects and advantages of the present invention will become apparent from the following description when read in view of the accompanying drawing and claims.

BRIEF DESCRIPTION OF THE DRAWING

FIG. 5 is a cross-sectional view of another embodiment of a separation nut assembly according to the present invention.

FIG. 6 *a, b, c* are cross-sectional views of the separation nut assembly of FIG. 5 showing the release-ejection sequence including (a) piston release, (b) segment release and (c) bolt ejection.

DESCRIPTION OF THE PREFERRED EMBODIMENT

Figure 1:
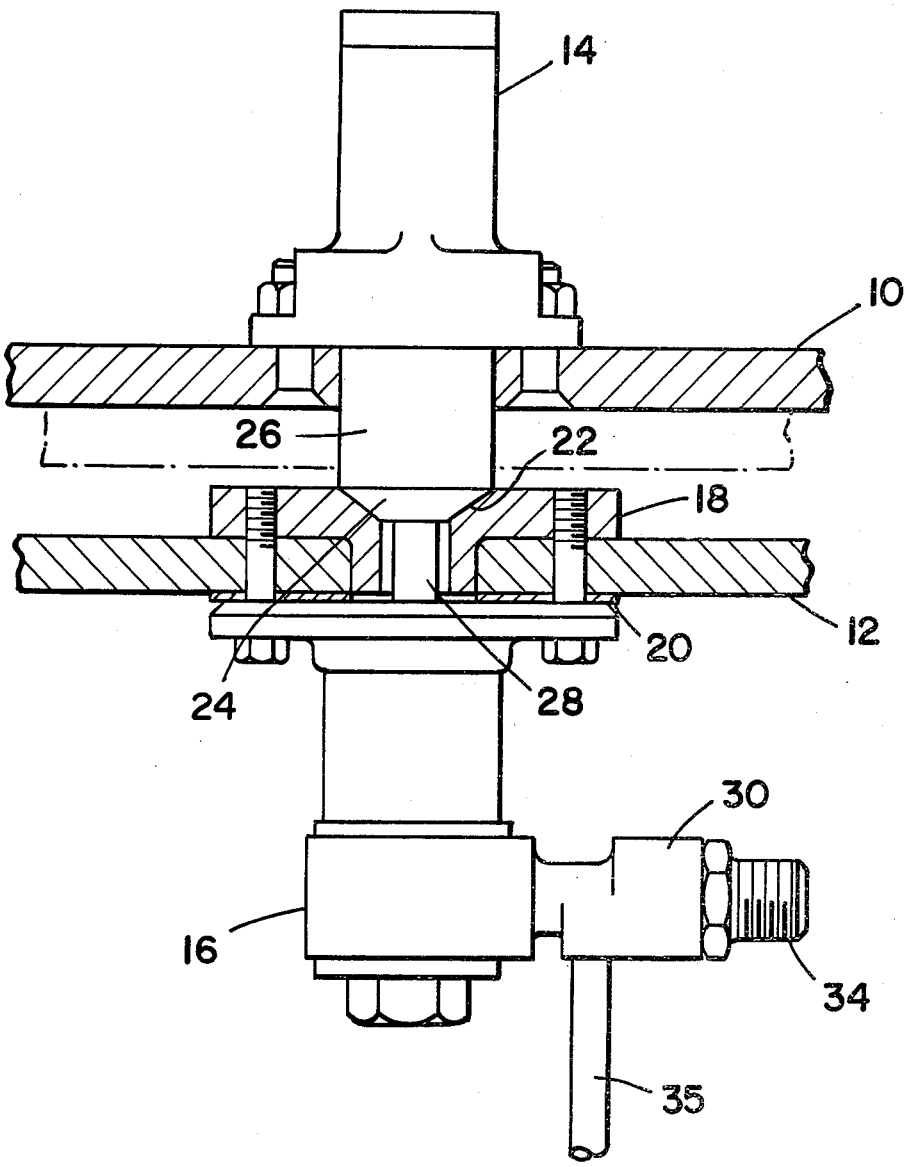
FIG. 1 is a plan view, partly in cross-section, of a separation nut assembly and bolt catcher assembly.
Figure 2:
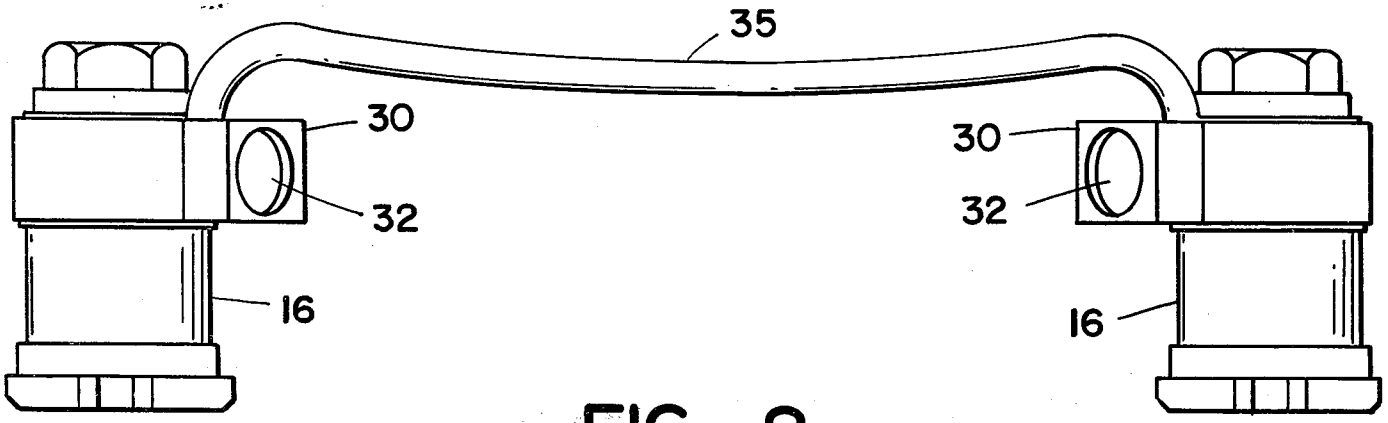
FIG. 2 is a perspective view of the separation nut system.

Referring now to FIGS. 1 and 2 a separation nut system is shown connecting two planes 10, 12 together, such planes being two stages of a missile for example. A bolt catcher assembly 14 is attached to one plane 10 by any suitable means such as rivets, screws or the like, and a separation nut assembly 16 is attached to the second plane 12 in a like manner. A conical seat 18 is attached to the second plane 12 with a washer 20 between the separation nut assembly 16 and the plane 12. The conical seat 18 has a recess 22 shaped to fit closely the end 24 of the body 26 of the bolt catcher assembly 14 to provide alignment of the bolt catcher assembly with the separation nut assembly 16. A bolt 28 extends from the end 24 of the bolt catcher assembly 14 into the separation nut assembly 16 where it is tightly gripped to assure connection of one plane 10 to the second plane 12.

A manifold 30 is attached to the separation nut assembly 16 in which an initiator port 32 is located. An initiator 34, such as an explosive squib or gas generator, is located in the initiator port 32. A manifold tube 35 connects the manifold 30 of one separation nut assembly 16 to the manifold of at least one other separation nut assembly.

Figure 3:
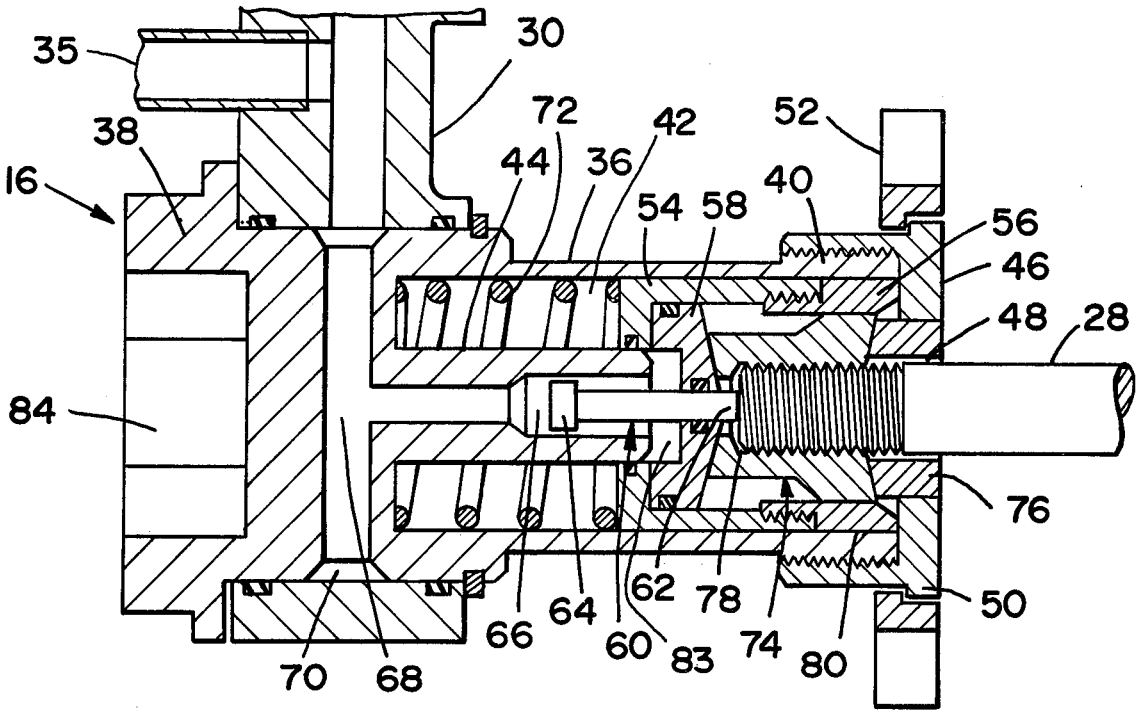
FIG. 3 is a cross-sectional view of one embodiment of a separation nut assembly according to the present invention.

FIG. 3 shows the details of one embodiment of the separation nut assembly 16. A case 36, approximately cylindrical in shape, has a head end 38, a base end 40, a central cavity 42 open at the base end and a central ejector post 44 extending from the head end into the cavity. A base assembly 46 is attached to the base end 40 of the case 36 having a central hole 48 to partially close the cavity 42, and having a peripheral lip 50. A flange 52 surrounds the base assembly 46, engaging the lip 50, and is secured to the second plane 12 to hold the separation nut assembly 16 in place.

A piston assembly 54 in the form of an inverted cup fits snugly about the ejector post 44 and against the interior wall of the case 36. The piston assembly 54 has a beveled lip 56. A separator 58 is slidably situated within the piston assembly 54 and has a central hole through which an ejector 60 protrudes. The ejector tip 62 rests against the bolt 28 and the ejector head 64 is located in an expanded chamber 66 within the ejector post 44 which is the base leg of a T-shaped port 68, the cross portion of the T-shaped port being within the head 38 and connecting to an exterior circumferential groove 70 in the head. A spring 72 is situated within the cavity 42 about the ejector post 44 between the piston assembly 54 and the head 38. A plurality of segments 74 grip the bolt 28 and are held in position by the separator 58 at the top, a beveled upward base projection 76 at the bottom and the inner walls of the piston lip 56 on the sides. The upper section 78 of the segment 74 has a smaller outside radius than the lower section 80, and the bevel between the two sections matches in angle the bevel of the piston lip 56.

The manifold 30 is situated about the head 38 and encloses the groove 70. The case 36 is allowed to slide within the manifold 30 so that the separation nut assembly 16 can be tightened to the bolt 28 without disturbing the relative position of the manifold which, as shown in FIG. 2, is connected to another manifold by the manifold tube 35. O-rings are used to provide a gas-tight seal between the various components so that gas generated by the squib initiator 34 is contained within the groove 70, the T-shaped port 68, the expanded chamber 66 and the pressure area 83 defined by the upper surface of the separator 58, the upper interior surface of the piston assembly 54 and the ejector post 44. The head 38 may have a nut inset 84 or a hexagonal nut external shape for ease of tightening the separation nut assembly 16 to the bolt 28.

Figure 4A:
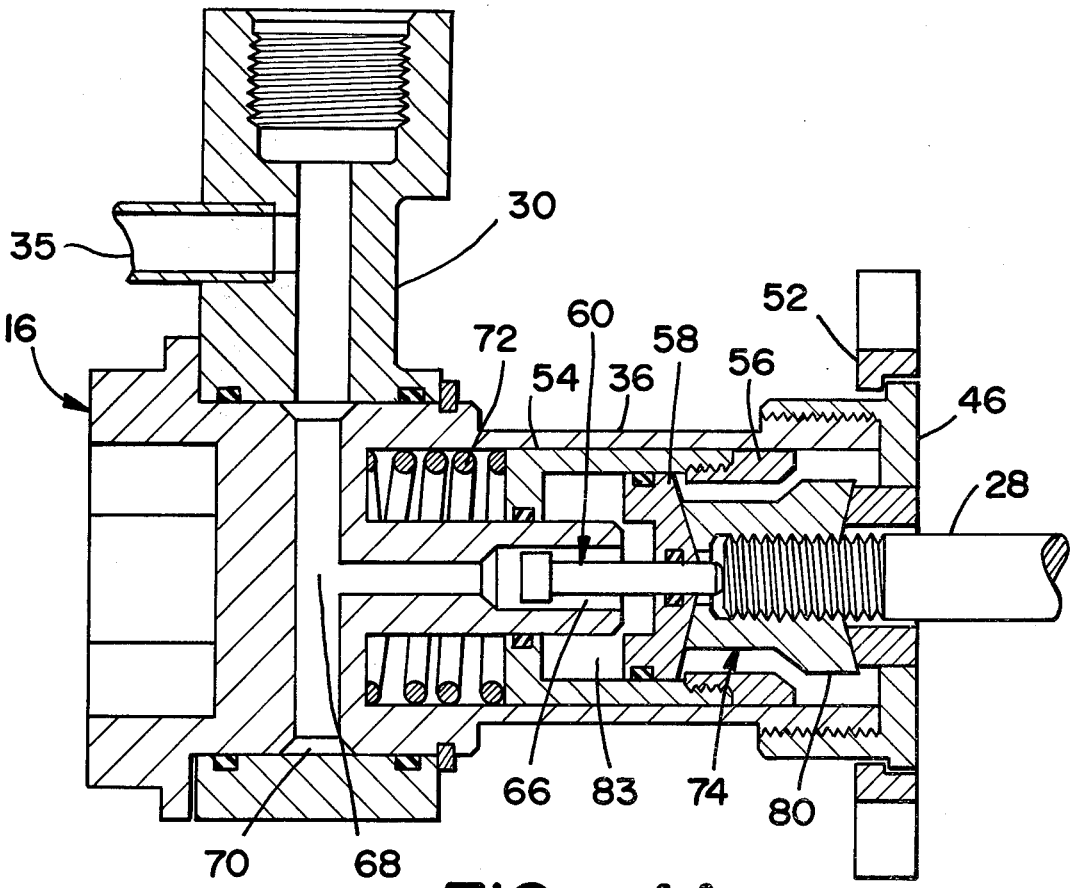
FIG. 4 *a, b, c* are cross-sectional views of the separation nut assembly of FIG. 3 showing the release-ejection sequence including (a) piston release, (b) segment release and (c) bolt ejection.
Figure 4B:
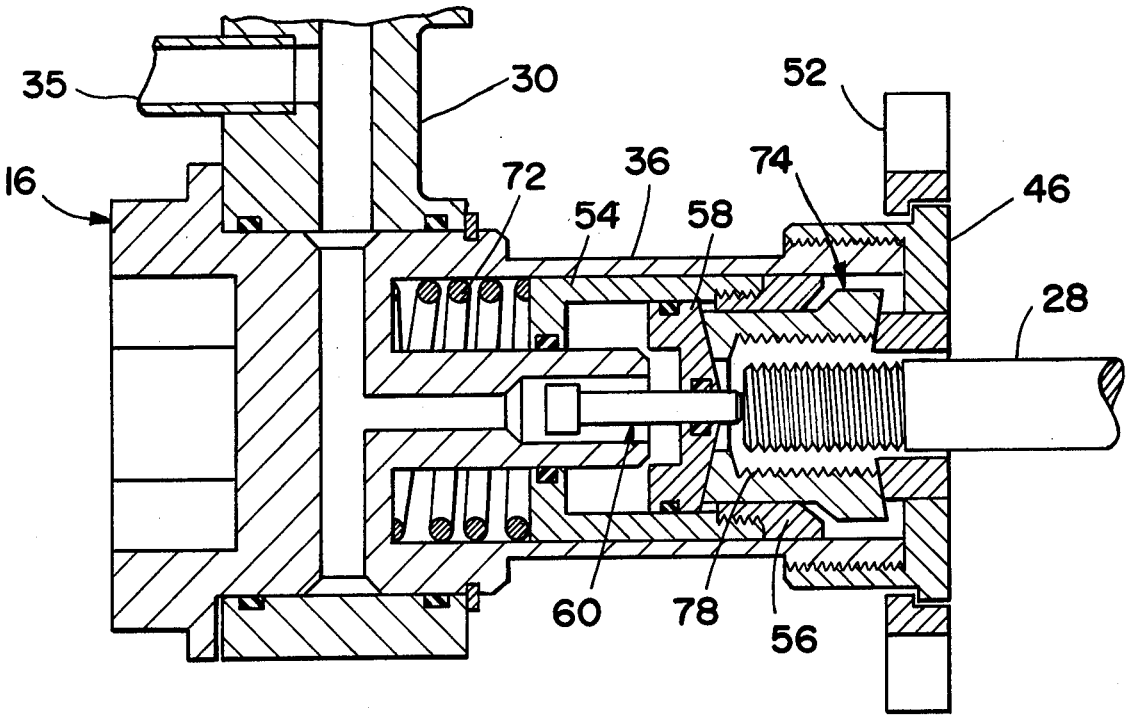
Figure 4C:
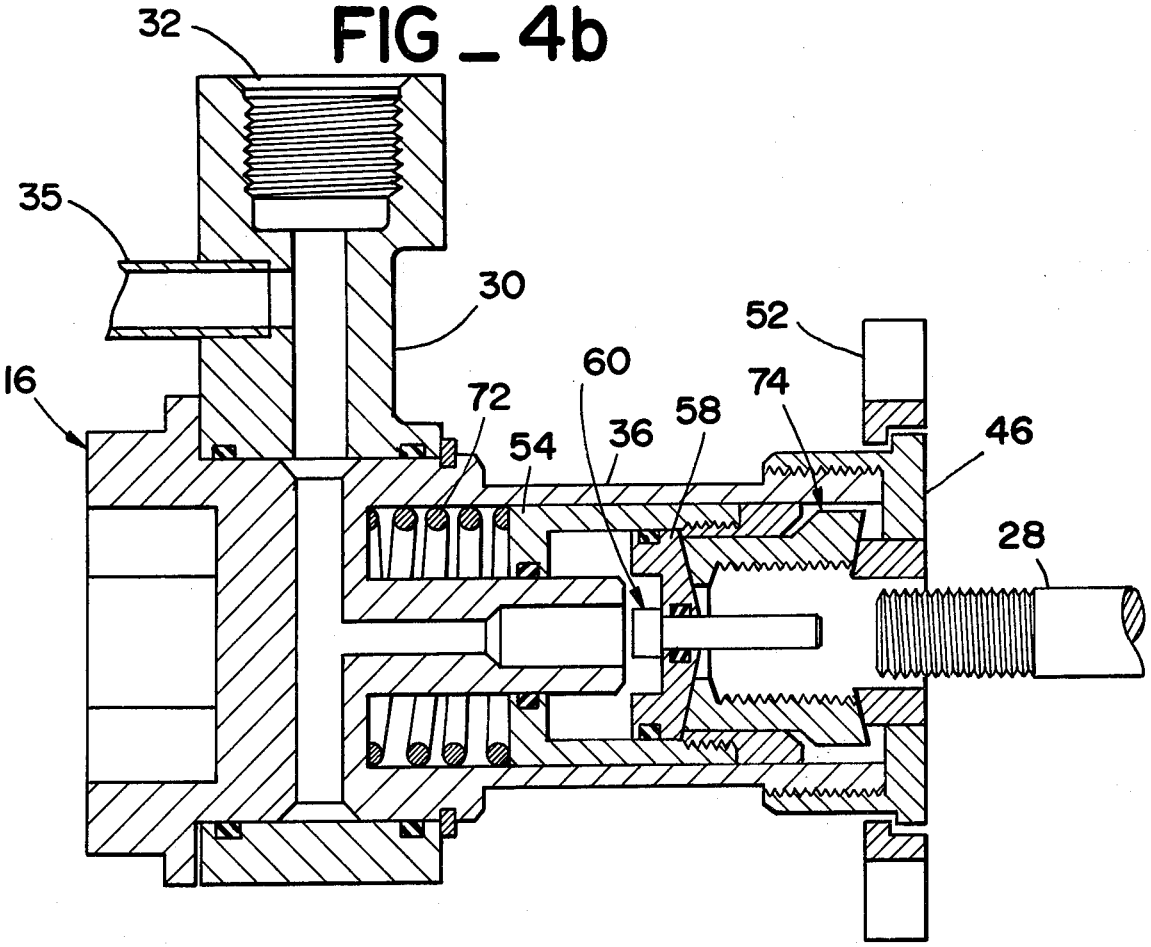

As shown in FIGS. 4 *a, b, c* when gas is introduced at the initiator port 32 it flows around the groove 70 into the T-shaped port 68, and then out the expanded chamber 66 into the pressure area 83. The gas pressure in the pressure area 83 causes the piston assembly 54 to move upward, compressing the spring 72, until the piston lip 56 clears the lower section 80 of the segments 74. At this point the separator 58 moves downward causing the segments 74 to move outward until the upper section 78 contacts the piston lip 56, releasing the bolt 28. The ejector 60 now moves downward, propelling the bolt 28 out of the separation nut assembly 16 into the bolt catcher assembly 14 completing separation of the planes 10, 12.

In cold gas testing of the separation nut system, after the gas pressure has dissipated itself the restoring force of the spring 72 forces the piston assembly 54 down which forces the segments 74 together again, restoring the separation nut assembly 16 to its initial state. Connection of another bolt 28 restores the ejector 60 to its initial position so that the separation nut system is again ready for use. Total actuation time is on the order of 6 milliseconds.

A second embodiment is shown in FIG. 5. The separation nut assembly 16 has a case 136 with a head end 138, a base end 140, a central cavity 142 open at the base end, and a peripheral lip 150. A base assembly 146 is attached interior to the base end 140 of the case 136 having a central hole 148 to partially close the cavity 142. A flange 152 surrounds the base end 140, engaging the lip 150, and is secured to the second plane 12 to hold the separation nut assembly 16.

A separator 158 is slidably situated within the upper portion of cavity 142 and has a central hole through which an ejector 160 protrudes. A piston assembly 154 in the form of an inverted cup fits snugly about the lower portion of the separator 158 and against the interior wall of the case 136. The piston assembly 154 has one or more beveled interior annular protrusions 156. The ejector head 164 is located snugly in an expanded chamber 166 within the separator 158. The expanded chamber 166 connects to a quadri-port 168 located in the head 138 which in turn connects to an exterior circumferential groove 170. A spring 172 is situated within the cavity 142 about the lower portion of the separator 158 interior to the piston assembly 154. A plurality of segments 174 grip the bolt 28 and have external annular protrusions 180. The segments 174 are held in position by the spring 172 at the top and a beveled upward base projection 176 at the bottom and the piston protrusions 156 against the segment protrusions 180 on the sides. O-rings provide a seal to contain the gas generated by the squib initiator 34 within the quadri-port 168 and the pressure region 183 between the head 138, and the separator 158 and ejector head 164.

As shown in FIGS. 6*a, b, c* gas introduced at initiator port 32 exerts downward pressure on separator 158 and ejector 160 causing piston 154 to also move downward, compressing spring 172. When the piston protrusions 156 clear the segment protrusions 180 the separator 158 forces the segments 174 radially outward, releasing bolt 28. The ejector 160 continues its downward movement to eject the bolt 28 into the bolt catcher assembly 14.

In cold gas testing of the separation nut system, after the gas pressure has dissipated itself the restoring force of the spring 172 forces the piston 154 and separator 158 upward, which in turn due to the interaction between the piston protrusions 156 and segment protrusions 180 cause the segments 174 to return to their original position. Connection of another bolt 28 again places the separation nut system in its initial condition ready for use.

Figure 7:
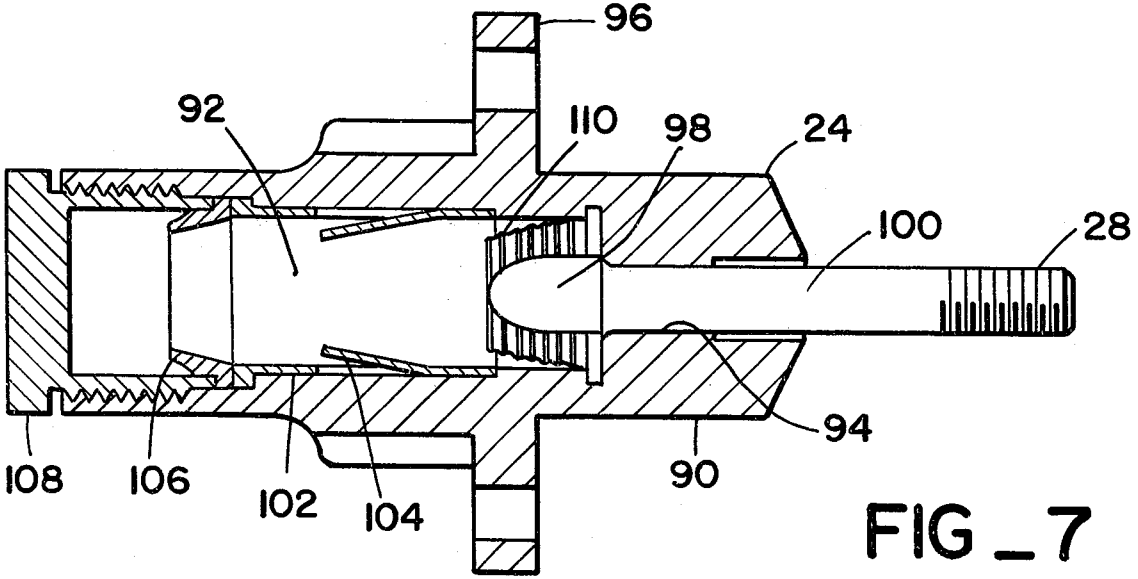
FIG. 7 is a cross-sectional view of the bolt catcher assembly showing the head of the bolt.

Referring now to FIG. 7 the bolt catcher assembly 14 has a body 90 having a catcher cavity 92 and a bolt hole 94 of diameter smaller than that of the catcher cavity. A flange 96 integral with the body 90 provides means for attaching the bolt catcher assembly 14 to one plane 10 by any suitable means such as screws, rivets, bolts or the like. The bolt head 98 is situated within the catcher cavity 92 with the bolt shaft 100 protruding through the bolt hole 94. A catcher 102 lines the catcher cavity 92 and has a plurality of resilient fingers 104 which are bent inwardly toward the center of the cavity. A conical ring 106 of a soft malleable material such as aluminum has inwardly sloping sides and is situated within the catcher cavity 92 above the catcher 102. A cap 108 seals the open end of the catcher cavity 92 and holds the conical ring 106 and catcher 102 securely in place.

The bolt head 98 is tapered and has a series of circumferential grooves 110. When the bolt 28 is forcibly ejected by the separation nut assembly 16, the bolt head 98 passes between the fingers 104 and embeds itself in the conical ring 106, the material of which fills the bolt head grooves 110 to prevent the bolt 28 from rebounding back to its initial position. Although the fingers 104 should catch the bolt head 98 as it rebounds, in practice without more than the fingers to catch the bolt the bolt 28 would vibrate back and forth once or twice before the resilience of the fingers would react fast enough to catch the bolt. Thus, the fluid deformation of the conical ring 106 about the bolt head grooves 110 prevents this undesirable vibratory action due to bolt 28 rebound.

Referring back to FIG. 2 the manifold tube 35 connecting the manifolds 30 of two or more separation nut assemblies 16 allows the gas generated by one initiator 34 to actuate all the separation nut assemblies connected to the manifold tube. For weight considerations the manifold tube. 35 should be as small as possible, but it must be large enough to provide virtual simultaneity of action of all the separation nut assemblies 16 connected to it by the action of a single initiator 34. The manifold tube 35 should also be sized to handle the pressure of all the initiators 34 to which it is connected.

Thus, the present invention provides a separation nut system with performance redundancy to avoid squib malfunction without using additional squibs, with automatic resetting so it can be cold gas tested for reliability without disassembly and reassembly after each use, and with positive bolt catching to avoid vibration disturbances caused by bolt rebound.

What is claimed is:

1. A separation nut system comprising:

(a) a plurality of separation nut assemblies, each having an initiator;

(b) a plurality of bolt catcher assemblies, one connected to each of said separation nut assemblies by a bolt;

(c) a manifold tube connecting each of said separation nut assemblies to the others such that the actuating gas generated by the initiator of one of said separation nut assemblies is distributed to actuate all of said separation nut assemblies; and (d) means for automatically restoring each of said separation nut assemblies to its initial condition after each actuation.

2. A separation nut system as recited in claim 1 wherein said bolt catcher assembly comprises means for positively retaining said bolt of each of said bolt catcher assemblies after ejection by actuation of said separation nut assemblies to prevent bolt rebound.

3. A separation nut system as recited in claim 2 wherein each of said separation nut assemblies comprises:

(a) a case having a head end and a base end, said base end having a central cavity and said head end having a port which communicates with said central cavity;

(b) a piston assembly slidably situated within said central cavity;

(c) a plurality of segments situated within said piston assembly to grip said bolt when said piston assembly is in a first position;

(d) a separator within said case situated to cooperate with said piston assembly in separating said segments when said piston assembly moves from said first position to a second position;

(e) a manifold which distributes the gas generated by said initiator through said port to move said piston assembly from said first position to said second position;

(f) a base assembly connected to said base end to retain said piston assembly, separator and segments within said central cavity, said base assembly having a central hole smaller than said cavity through which said bolt intrudes; and (g) an ejector slidably situated with said separator to forcibly eject said bolt from said separation nut assembly when said segments are separated in response to the gas generated by said initiator.

4. A separation nut assembly as recited in claim 3 wherein said restoring means is a spring situated within said case in such a position as to be compressed when said piston assembly moves from said first position to said second position so that the spring force automatically returns said piston assembly to said first position.

5. A separation nut system as recited in claim 2 wherein said bolt catcher assembly further comprises:

(a) a catcher case having a hole for said bolt at one end smaller than the diameter of the head of said bolt and a catcher cavity at the other end which connects with said hole;

(b) a catcher lining the interior of said catcher cavity, said catcher having resilient fingers extending inwardly such that the bolt head may pass through freely when ejected into said bolt catcher assembly, but may not pass in the opposite direction; and (c) a cap connected to the catcher cavity end of said catcher case to hold said catcher securely in place.

6. A separation nut system as recited in claim 5 wherein said retaining means comprises a conical ring of a deformable material situated within said cavity adjacent said catcher next to the exterior opening of said catcher cavity, said bolt head having circumferential grooves into which said material flows to securely hold said bolt when ejected, said conical ring being held securely in place by said cap.

* * * * *